United States Patent [19]

Patamaa

[11] 4,050,868

[45] Sept. 27, 1977

[54] CASTING MACHINE FOR CASTING CONCRETE ELEMENTS

[76] Inventor: Esko Patamaa, 03100 Nummela, Finland

[21] Appl. No.: 685,218

[22] Filed: May 11, 1976

[30] Foreign Application Priority Data

May 13, 1975 Finland ..... 751397

[51] Int. Cl.[2] ..... B28B 1/08; B28B 13/02

[52] U.S. Cl. ..... 425/135; 425/432; 425/447; 425/456

[58] Field of Search ..... 425/219, 258, 432, 447, 425/449, 456, 135; 404/106; 259/54, 72

[56] References Cited

U.S. PATENT DOCUMENTS

| | | | |
|---|---|---|---|
| 3,601,870 | 8/1971 | Jones | 425/432 |
| 3,839,918 | 10/1974 | Fisher | 259/72 |
| 3,969,056 | 7/1976 | Larsen | 425/218 |

FOREIGN PATENT DOCUMENTS

| | | | |
|---|---|---|---|
| 2,323,780 | 11/1974 | Germany | 425/456 |

*Primary Examiner*—Francis S. Husar
*Assistant Examiner*—John McQuade
*Attorney, Agent, or Firm*—Scully, Scott, Murphy & Presser

[57] ABSTRACT

A casting machine for casting concrete elements comprising a support frame continuously movable above a casting mould and provided with means for feeding concrete into the mould. A vibrating device is slidably supported by the support frame and is provided with locking means engaging said mould for momentarily fastening the vibrating device unmovably to said mould during vibration of said mould while sliding with respect to the support frame from a starting position due to the continuous movement of the support frame. The support frame is provided with means for slidable retraction of the vibrating device with respect to the support frame to said starting position after vibration of the mould and unlocking of said locking means.

6 Claims, 8 Drawing Figures

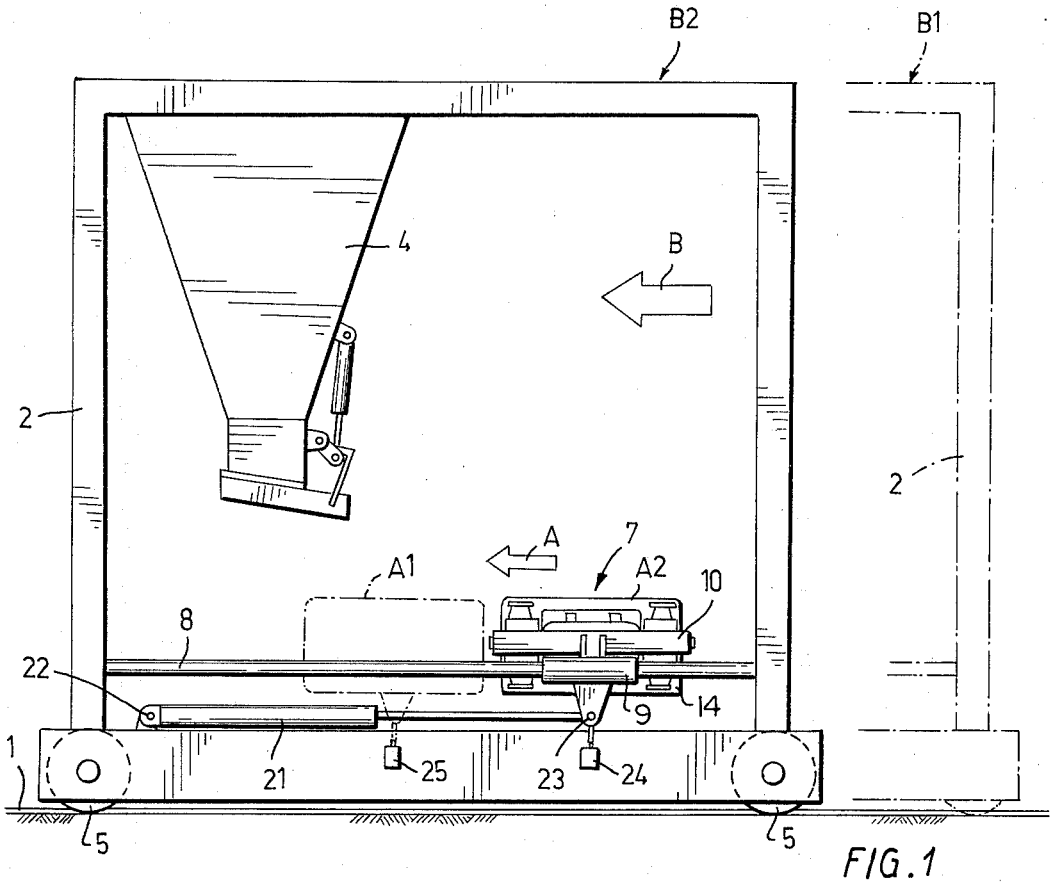
FIG. 1
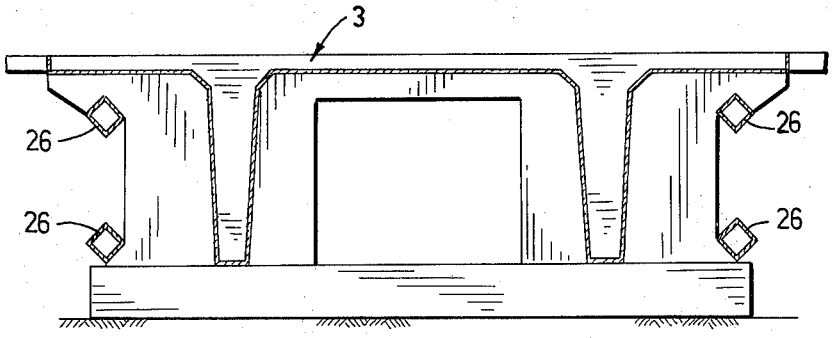
FIG. 6
FIG. 7
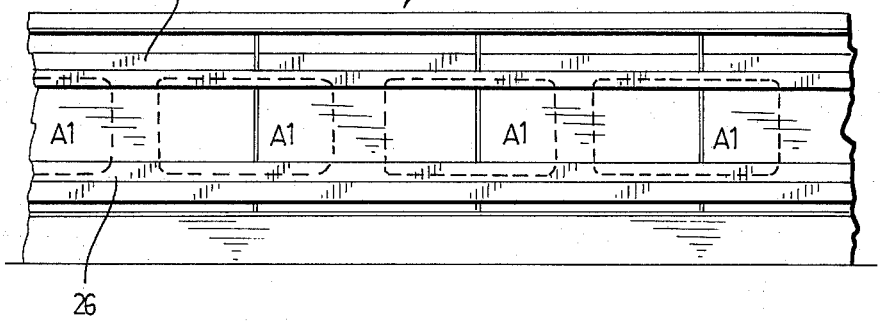

V
V
7
11
12
13
14
15
16
17
18
19
20
26
27

CASTING MACHINE FOR CASTING CONCRETE ELEMENTS

The subject of the present invention is a casting machine for casting concrete elements, which casting machine comprises a support frame moving above the casting mould, which support frame is provided with means for feeding the concrete into the mould and with a vibrating device for vibrating the mould as well as with a mechanism for moving the support frame along the mould during feeding of the concrete.

When concrete elements, such as TT-slabs, prestressed beams, and equivalent, are cast by means of a casting machine that, when feeding concrete into the casting mould, continuously moves forward from one end of the casting mould to the other end, in order to secure uniform and tight filling of the mould it is necessary to vibrate the mould during casting.

It is a previously known arrangement that a number of vibrators are, at mutual distances, fastened permanently to the sides of the casting mould, and when the casting proceeds, these vibrators are alternately switched on for the purpose of vibrating the mould. Such a mode of vibrating, however, requires several fixed vibrators per mould and is, consequently, expensive to put into effect. Moreover, switching the vibrators on at the correct moment is complicated in practice.

It is another previously known arrangement that the vibrating device is fastened permanently to the casting machine, whereby the vibrating device is constantly in operation and thereby always vibrates the section of the mould to which concrete is being fed at each particular time. For this mode of vibration, in fact, one vibrator on each side of the casting machine is sufficient, but the transmission of the vibrating movement to the mould is poor owing to the play appearing between the vibrating device and the casting mould, which play is necessary in order to permit continuous forward movement of the casting machine.

Another known arrangement is to fasten vibrator rods to the continuously mobile casting machine, which rods are from above the mould mechanically lowered into the mould for the period of vibration and which, as sunk into the concrete in the mould, only vibrate the surrounding concrete. This method is not suitable for the production of elements with dense reinforcement rod arrangement, of which type the elements usually are. For example, when a TT-slab is being cast, by this method it is only possible to vibrate the concrete that constitutes the carrying rib portion of the TT-slab, whereas the plate portion remains unvibrated. Nor is it possible to make the reinforcement rods in the moulds vibrate, which would promote tight filling of the mould, and the mould itself does not come into vibrating movement at all.

The purpose of the present invention is to provide a casting machine that permits installation of the vibrating device on the casting machine and nevertheless permits vibration of the casting mould without any play bwetween the mould and the vibrating device. This purpose is achieved by means of the casting machine in accordance with the present invention, which is characterized in that the vibrating device is mounted, as gliding in the direction of movement of the support frame, on the support frame and is provided with locking so that the vibrating device can be momentarily fastened rigidly to the casting mould for the time of vibration in spite of the proceeding movement of the support frame.

By installing the vibrating device as mobile on the casting machine, it is possible to lock the vibrating device momentarily to the side of the casting mould so that the vibrating device can perform its vibrating function as fastened without play and as completely immobile on the casting mould, whereby the vibrating movement can be transmitted to the mould in an optimum way despite the fact that the casting machine itself moves forward continuously. Since the vibrating device is fastened to the mould, the mould can be brought into a vibrating movement within a sufficiently long area at the casting point, which is important so as to level out the, in practice even highly uneven, layer of concrete fed into the mould so that the surface-levelling devices coming afterwards can perform their duty. This is a great advantage as compared with a machine with rod vibration. After the casting machine has, during vibration, proceeded a certain distance, the vibrating device is loosened from its grip with the mould and shifted to a new point, at which the vibrating device is again locked to the mould for the time of vibration. When proceeding like this, it is possible to direct at the mould an efficient vibration with no play at different points of the mould despite the fact that the vibrating device moves along with the casting machine and is not installed as permanently fixed. In this way the number of vibrating devices can be restricted to one per each side of the mould without deteriorating the quality of vibration.

The invention will be described more closely below with reference to the attached drawings, wherein FIG. 1 shows a side view of an advantageous embodiment of a casting machine in accordance with the invention.

FIGS. 3 to 5 are more detailed views of the vibrating device as a front view, as an end view in partial section, and as section along the line V — V in FIG. 3, respectively.

FIG. 6 shows a casting mould as a cross-section, and

FIG. 7 shows the casting mould as a side view.

Figure 2:
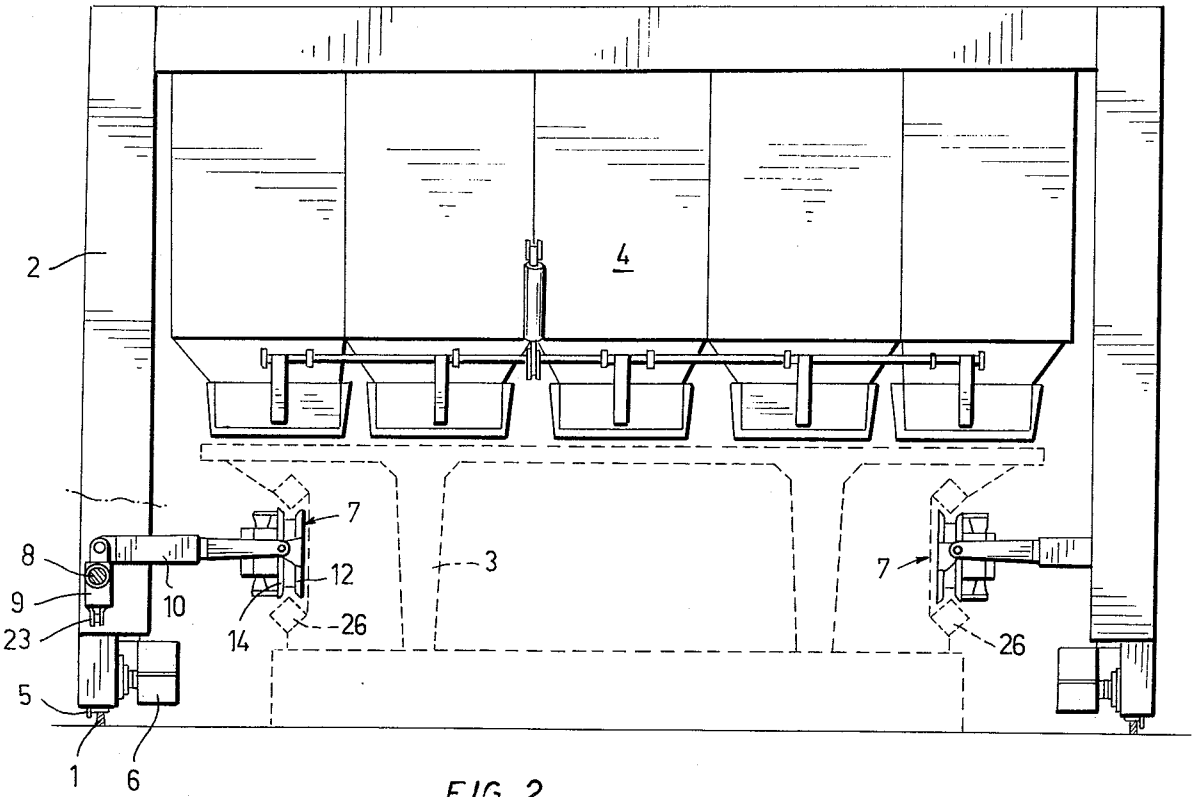
FIG. 2 shows the casting machine as viewed from the end.

The casting machine shown in FIGS. 1 and 2 of the drawings comprises a scaffold-like support frame 2 moving along horizontal rails 1. The support frame is designed as mobile along the casting mould 3 (FIG. 2) from end to end in order to fill the mould with concrete. For this purpose the support frame is provided with a concrete tank 4, at the bottom of which there are several vibrating feeders side by side, which feeders are placed above the casting mould extending over its entire width. In the drawings, for the sake of clarity, all other conventional equipment and auxiliary means, such as vibrators, levellers, guiding and positioning means, drive motors, etc. have been omitted. For moving the support frame during the casting continuously along the casting mould, the wheels 5 are preferably provided with drive mechanisms 6 of their own.

In accordance with the invention, on the opposite sides of the support frame that move along the two sides of the casting mould, vibrating devices 7 are mounted for the purpose of vibrating the casting mould during casting. Each vibrating device is glidably mounted on a horizontal guide 8 supported by the support frame by means of a sleigh or carriage 9, which sleigh is glidably mounted on said guide and which supports the vibrating mechanism proper by means of a fork-shaped support arm 10. To the ends of the support arm is by means of support pins 11 mounted a first grasping disk 12, to which a second grasping disk 14 is connected as mobile by means of bolts 13. The arrangement is here such that the grasping disk 14 can move towards and off the other grasping disk 12 as guided by guide pins 15. Between a support disk 16 fastened by bolts 13 and a counter-disk 17 supported by the grasping disk 14, an expansion hose 18 is placed whose ends are sealed and which can be, by means of connector 19, connected to a source of pressure fluid, which is not shown. A motor vibrator 20 is fastened to the first grasping disk 12.

A hydraulic cylinder 21 has been arranged for moving the vibrating device 7 along the guide 8, which cylinder is fastened between the bracket 22 on the support frame and the bracket 23 on the sleigh 9. By means of the hydraulic cylinder, the sleigh 9 can be moved between the position A2 shown in FIG. 1 with full line and the position A1 shown with broken line. Limit switches 24, 25 control the operations of the hydraulic cylinder.

FIGS. 6 and 7 show a casting mould 3, in connection with which the casting machine described above is supposed to be used. The casting mould is designed for casting so-called TT-slabs. The casting mould is of a construction in itself known, and horizontal pairs of guides 26 are fastened to its opposite sides. The arrangement is here such that, when the support frame is placed on its rails above the casting mould, the vibrating devices 7 extend on both sides of the casting mould in between the guides 26 as shown in FIG. 2. The grasping disks 12 and 14 thus come to be placed on different sides of the vertical plane of the guides, as comes out from FIGS. 4A and 4B.

Figures 3, 4A, 4B, 5:
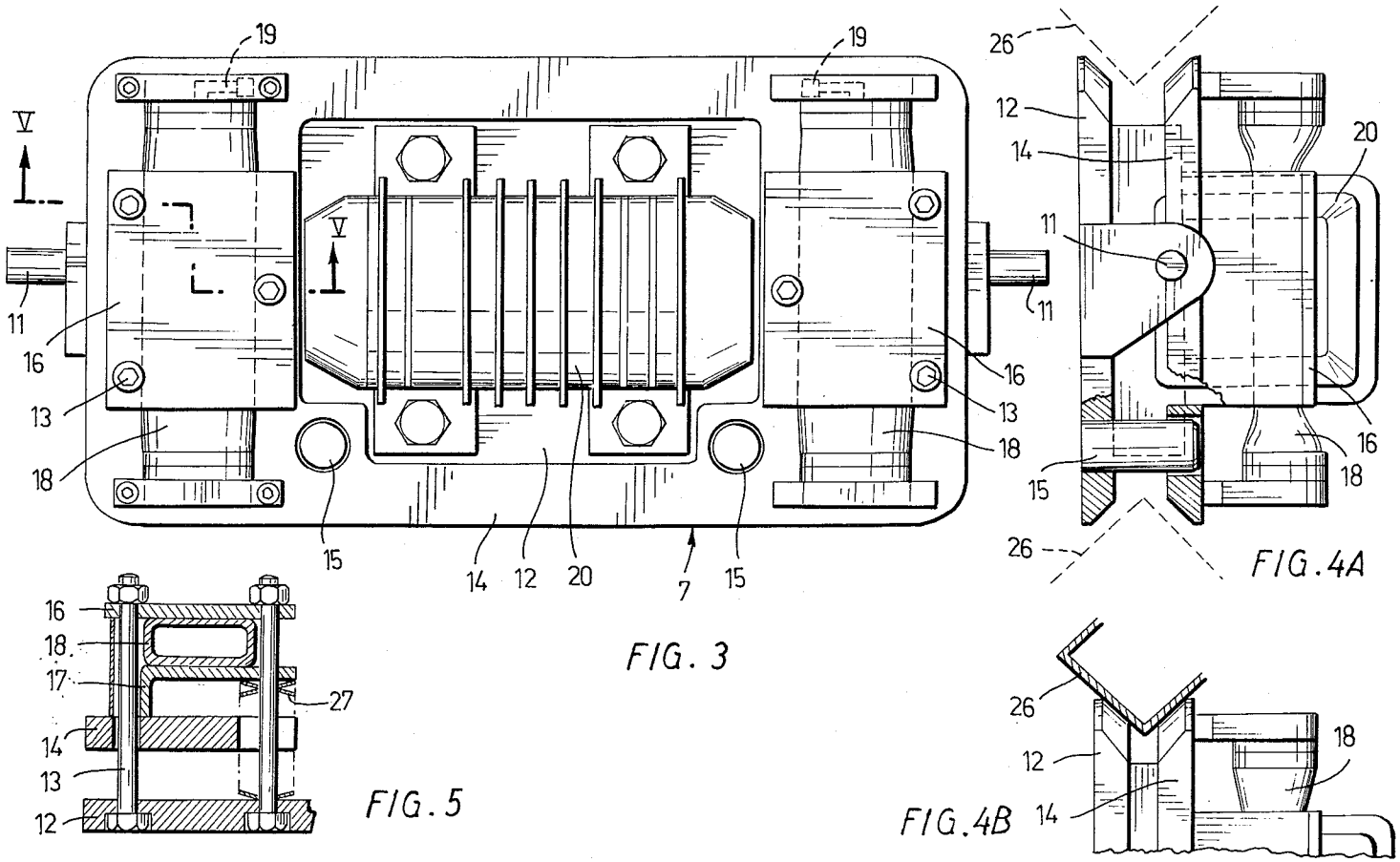

As illustrated in FIG. 4A of the drawings, the disks 12 are shown in an unlocked position, whereas in FIG. 4B the disks 12 are shown in a locked position pressing against the guides 26.

The casting machine operates as follows:

The casting machine is started as moving from one end of the mould along the rails 1 continuously in the direction of the arrow B (FIG. 1) towards the other end of the mould. The concrete is fed under control from the tanks 4 into the mould. The vibrating device 7 placed in its projected position is locked rigidly on the pair of guides 26 of the casting mould by passing pressurized fluid into the expansion hoses 18, whereby they are expanded and force the grasping disk 14 towards the grasping disk 12. As a result of this, both grasping disks are, from opposite sides, pressed against the guides 26 thereby fastening the entire vibrating device firmly onto the guides, as is shown in FIG. 4B. At the same time, the motor vibrator 20 is started, which transmits the movement of vibration straight to the casting mould without any play. When the casting machine has proceeded from the point B1 presented with dotted broken line in FIG. 1 to the point B2 shown with full line, the support frame has moved to such an extent in relation to the stationary vibration device that the latter has come to its rear position A2 shown in FIG. 1 will full line, at which position the contact finger of the sleigh touches the limit switch 24. The limit switch sends an impulse for stopping the motor vibrator and for removing the overpressure from the expansion hoses so that the grasping disks 12, 14 again become more distant from each other as pushed by springs 27. In this way the grasping disks become free from their grasp with the guides 26 of the casting mould, as is shown in FIG. 4A. The impulse of the limit switch also engages the hydraulic cylinder 21 in operation so that it pulls the sleigh 9 in the direction of the arrow A back to the front position A1 shown with broken line in FIG. 1. Then the contact finger of the sleigh touches the limit switch 25, on the account of an impulse sent by which the hydraulic cylinder 21 stops, the fluid pressure is engaged on the expansion hoses, and the motor vibrator is started. In this way the vibrating device has been connected rigidly to the guides of the casting mould in a new vibrating position. In FIG. 7 these subsequent vibrating positions are indicated with A1. It is noticed that the casting mould can be vibrated at several subsequent vibrating points despite the fact that the support frame moves continuously forward and that the casting machine is provided with one vibrating device only on each side of the casting mould.

The drawing and the related description are only intended to illustrate the idea of the invention. In its details, the casting machine in accordance with the invention may show even considerable variation within the scope of the patent claims. Thus, it is advantageous that the vibrating device is mounted telescopically on the support arm and that the support arm can be pivoted in the vertival plane so that the same casting machine can be used for casting moulds of different widths. Except a cylinder operated by a pressure medium, it is possible to use for shifting the vibrating device, for example, a screw operated by an electric motor, a chain or wire operated by an electric or pressure-medium motor, a spring, or a counter-pressure, etc. There may also be only one support guide in the mould. Besides an expansion hose, it is also possible to use a hydraulic or pneumatic cylinder or box etc. for locking the vibrator.

I claim:

1. A casting machine for casting concrete elements, said casting machine comprising a support frame (2) situated for movement above a cast mould (3), said support frame including means (4) for feeding the concrete into the mould, a vibrating device (7) for vibrating the mould and a mechanism (6) for moving the support frame along the mould during feeding of the concrete, characterized in that said vibrating device (7) is mounted on said support frame so as to be glideable in the direction of movement (B) of the support frame (2), locking units (12, 14) being located on said vibrating device whereby the vibrating device is adapted to be momentarily fastened, without play, to the casting mould (3) for the time of vibration irrespective of the continual movement of the support frame, a carriage (9) for supporting said vibrating device, a guide (8) supporting said carriage for movement therealong an in parallel with the direction of movement of said support frame, said guide being supported by the support frame, and shifting means (21) being connected to said carriage for moving the carriage along the guide.

2. A casting machine as claimed in claim 1, said shifting means (21) comprising a hydraulic cylinder, limit switches (24, 25) for controlling the operation of said hydraulic cylinder being located along the path of movement of the carriage (9) whereby, upon the sleigh reaching the extreme rear position (A2) of its range of movement relative to the direction of movement (B) of the support frame, the hydraulic cylinder shifts the sleigh to the extreme front position (A1) of its range of movement.

3. A casting machine as claimed in claim 2, said casting mould (3) including support guides (26) extending in parallel with the movement of the support frame (2), along which the vibrating device (7) is moveable, said locking means (12, 14) being arranged so as to be fastenable to said support guides (26).

4. A casting machine as claimed in claim 3, said locking means comprising two grasping disks (12, 14) adjustably positionable relative to each other, one of said disks being connected to the carriage (9) and the other disk being connected to an expansion unit (18) which, in the expanded position thereof, presses the grasping disks from opposite sides against the support guides (26).

5. A casting machine as claimed in claim 4, said expansion unit (18) comprising an expansion hose connected to a source of pressure fluid.

6. A casting machine as claimed in claim 4, at least one of said grasping disks (12, 14) having a face pressing against the mould (3) at an oblique angle to the direction of the locking movement of the grasping disk.

* * * * *